US008676078B2

(12) United States Patent
Saito et al.

(10) Patent No.: US 8,676,078 B2
(45) Date of Patent: Mar. 18, 2014

(54) FIXING DEVICE, IMAGE FORMING APPARATUS INCORPORATING SAME, AND METHOD FOR FIXING TONER IMAGE ON RECORDING MEDIUM

(75) Inventors: Kazuya Saito, Kanagawa (JP); Tadashi Ogawa, Tokyo (JP); Takeshi Uchitani, Kanagawa (JP); Satoshi Ueno, Tokyo (JP); Teppei Kawata, Kanagawa (JP); Takamasa Hase, Tokyo (JP); Shuutaroh Yuasa, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 210 days.

(21) Appl. No.: 13/291,453

(22) Filed: Nov. 8, 2011

(65) Prior Publication Data

US 2012/0114354 A1 May 10, 2012

(30) Foreign Application Priority Data

Nov. 10, 2010 (JP) ..... 2010-252055
Dec. 6, 2010 (JP) ..... 2010-271607

(51) Int. Cl.
*G03G 15/20* (2006.01)

(52) U.S. Cl.
USPC ..... 399/69; 399/43; 399/88

(58) Field of Classification Search
USPC ..... 399/69, 43, 67, 88
See application file for complete search history.

(56) References Cited

U.S. PATENT DOCUMENTS 7,266,336 B2 9/2007 Ueno et al.
7,450,872 B2 11/2008 Ueno et al.
7,491,917 B2 2/2009 Ueno
7,509,085 B2 3/2009 Yoshinaga et al.
7,546,049 B2 6/2009 Ehara et al.
7,672,605 B2 3/2010 Kayahara et al.
7,693,439 B2 4/2010 Seo et al.
7,715,774 B2 5/2010 Ueno
7,734,208 B2 6/2010 Seo et al.
7,778,581 B2 8/2010 Seo et al.
7,783,240 B2 8/2010 Ito et al.
7,796,933 B2 9/2010 Ueno et al.
7,801,457 B2 9/2010 Seo et al.
7,817,952 B2 10/2010 Seo et al.

(Continued)

FOREIGN PATENT DOCUMENTS

JP 4194387 A 7/1992
JP 2002357980 A 12/2002

(Continued)

*Primary Examiner* — Sophia S Chen

(74) *Attorney, Agent, or Firm* — Harness, Dickey & Pierce, P.L.C.

(57) ABSTRACT

A fixing device includes a pressing rotary body pressed against a fixing rotary body to form a fixing nip therebetween through which a recording medium bearing a toner image is conveyed; a heater to heat the fixing rotary body, disposed opposite a circumferential surface of the fixing rotary body and upstream from the fixing nip a predetermined circumferential distance along the circumferential surface of the fixing rotary body in a direction of rotation of the fixing rotary body; a heater driver to turn on and off the heater; a timing calculator to calculate a reference time at which a trailing end portion of the recording medium in a conveyance direction of the recording medium reaches the fixing nip; and a heater driver controller to cause the heater driver to turn off the heater at a turn-off time earlier than the reference time.

17 Claims, 5 Drawing Sheets

(56) References Cited

U.S. PATENT DOCUMENTS

| | | | | |
|---|---|---|---|---|
| 7,885,590 | B2 | 2/2011 | Seo et al. | |
| 7,925,177 | B2 | 4/2011 | Ishii et al. | |
| 7,983,582 | B2 | 7/2011 | Hase | |
| 8,014,711 | B2 | 9/2011 | Ito et al. | |
| 2003/0016963 | A1* | 1/2003 | Yoshinaga et al. | 399/69 |
| 2003/0059224 | A1* | 3/2003 | Tomita et al. | 399/88 |
| 2004/0101334 | A1* | 5/2004 | Tatematsu et al. | 399/329 |
| 2005/0191098 | A1 | 9/2005 | Ueno et al. | |
| 2006/0029411 | A1 | 2/2006 | Ishii et al. | |
| 2006/0165443 | A1 | 7/2006 | Yoshinaga et al. | |
| 2006/0289419 | A1 | 12/2006 | Ueno | |
| 2007/0014600 | A1 | 1/2007 | Ishii et al. | |
| 2007/0059011 | A1 | 3/2007 | Seo et al. | |
| 2007/0201916 | A1 | 8/2007 | Ueno | |
| 2007/0212089 | A1 | 9/2007 | Seo et al. | |
| 2007/0264060 | A1 | 11/2007 | Ueno et al. | |
| 2007/0280754 | A1 | 12/2007 | Ogawa et al. | |
| 2008/0025772 | A1 | 1/2008 | Seo et al. | |
| 2008/0025773 | A1 | 1/2008 | Ito et al. | |
| 2008/0044196 | A1 | 2/2008 | Seo et al. | |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2009/0148205 | A1 | 6/2009 | Seo et al. | |
| 2009/0245897 | A1 | 10/2009 | Seo et al. | |
| 2009/0297197 | A1 | 12/2009 | Hase | |
| 2009/0317102 | A1* | 12/2009 | Hasegawa et al. | 399/45 |
| 2010/0014903 | A1 | 1/2010 | Seto et al. | |
| 2010/0061753 | A1 | 3/2010 | Hase | |
| 2010/0158553 | A1 | 6/2010 | Ueno | |
| 2010/0232844 | A1 | 9/2010 | Saito et al. | |
| 2010/0239292 | A1 | 9/2010 | Fujita et al. | |
| 2010/0303521 | A1 | 12/2010 | Ogawa et al. | |
| 2011/0026988 | A1 | 2/2011 | Yoshikawa et al. | |
| 2011/0044734 | A1 | 2/2011 | Shimokawa et al. | |
| 2011/0052237 | A1 | 3/2011 | Yoshikawa et al. | |
| 2011/0052277 | A1 | 3/2011 | Ueno et al. | |
| 2011/0058862 | A1 | 3/2011 | Yamaguchi et al. | |
| 2011/0058863 | A1 | 3/2011 | Shinshi et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0176821 | A1 | 7/2011 | Hase | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0217056 | A1 | 9/2011 | Yoshinaga et al. | |
| 2011/0217093 | A1 | 9/2011 | Tokuda et al. | |
| 2011/0217095 | A1 | 9/2011 | Ishii et al. | 399/329 |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | 399/329 |
| 2011/0222930 | A1 | 9/2011 | Fujimoto et al. | |
| 2011/0222931 | A1 | 9/2011 | Shinshi et al. | 399/329 |
| 2011/0229161 | A1 | 9/2011 | Ueno et al. | |
| 2011/0229162 | A1 | 9/2011 | Ogawa et al. | |
| 2011/0229178 | A1 | 9/2011 | Ogawa et al. | |
| 2011/0229180 | A1 | 9/2011 | Saito | |
| 2011/0229181 | A1 | 9/2011 | Iwaya et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | 399/45 |
| 2011/0311284 | A1 | 12/2011 | Seo et al. | 399/329 |

FOREIGN PATENT DOCUMENTS

| | | | |
|---|---|---|---|
| JP | 2003076189 | A | 3/2003 |
| JP | 2004102104 | A | 4/2004 |
| JP | 2007193241 | A | 8/2007 |
| JP | 2008134519 | A | 6/2008 |

* cited by examiner

FIXING DEVICE, IMAGE FORMING APPARATUS INCORPORATING SAME, AND METHOD FOR FIXING TONER IMAGE ON RECORDING MEDIUM

CROSS-REFERENCE TO RELATED APPLICATIONS

This patent application is based on and claims priority pursuant to 35 U.S.C. §119 to Japanese Patent Application Nos. 2010-252055, filed on Nov. 10, 2010, and 2010-271607, filed on Dec. 6, 2010, in the Japan Patent Office, the entire disclosure of each of which is hereby incorporated by reference herein.

FIELD OF THE INVENTION

Example embodiments generally relate to a fixing device, an image forming apparatus, and a method for fixing a toner image on a recording medium, and more particularly, to a fixing device for fixing a toner image on a recording medium, an image forming apparatus including the fixing device, and a method used by the fixing device.

BACKGROUND OF THE INVENTION

Related-art image forming apparatuses, such as copiers, facsimile machines, printers, or multifunction printers, having at least one of copying, printing, scanning, and facsimile functions, typically form an image on a recording medium according to image data. Thus, for example, a charger uniformily charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Typically, the fixing device may include a fixing roller heated by a heater, and a pressing roller pressed against the fixing roller to form a fixing nip therebetween through which the recording medium passes. As a recording medium bearing a toner image passes through the fixing nip, the fixing roller and the pressing roller apply heat and pressure to the recording medium to melt and fix the toner image on the recording medium. Thereafter, the recording medium bearing the fixed toner image is discharged from the fixing nip.

As the recording medium passes through the fixing nip, the recording medium draws heat from the fixing roller and the pressing roller, thus cooling them. The heater is designed to take this factor into account. For example, the heater is turned on to heat the fixing roller to a predetermined fixing temperature. However, if the heater heats the fixing roller even after the recording medium is discharged from the fixing nip, the fixing roller may be overheated. To address this problem, operation of the heater is controlled to maintain the temperature of the fixing roller at the predetermined fixing temperature. For example, the heater is turned off after the trailing edge of the recording medium enters the fixing nip. Accordingly, after the recording medium is discharged from the fixing nip, the fixing roller does not overheat.

However, this control method for controlling the heater has a drawback when used in conjunction with a configuration of the fixing device in which the heater is disposed a given distance upstream from the fixing nip in the direction of rotation of the fixing roller. For example, even if the heater is turned off after the trailing edge of the recording medium enters the fixing nip, the heater has already heated an upstream section on the surface of the fixing roller upstream from the fixing nip in the direction of rotation of the fixing roller that will not contact the recording medium and therefore is not used for fixing the toner image on the recording medium, thus wasting power.

BRIEF SUMMARY OF THE INVENTION

At least one embodiment may provide a fixing device that includes a fixing rotary body rotatable in a predetermined direction of rotation; a pressing rotary body disposed parallel to and pressed against the fixing rotary body to form a fixing nip therebetween through which a recording medium bearing a toner image is conveyed; a heater to heat the fixing rotary body, disposed opposite a circumferential surface of the fixing rotary body and upstream from the fixing nip a predetermined circumferential distance along the circumferential surface of the fixing rotary body in the direction of rotation of the fixing rotary body; a heater driver operatively connected to the heater to turn on and off the heater; a timing calculator to calculate a reference time at which a trailing end portion of the recording medium in a conveyance direction of the recording medium reaches the fixing nip; and a heater driver controller operatively connected to the timing calculator and the heater driver to cause the heater driver to turn off the heater at a turn-off time earlier than the reference time calculated by the timing calculator.

At least one embodiment may provide an image forming apparatus that includes the fixing device described above.

At least one embodiment may provide a method for fixing a toner image on a recording medium, that includes steps of rotating a fixing rotary body in a predetermined direction of rotation; pressing a pressing rotary body against the fixing rotary body to form a fixing nip therebetween through which the recording medium bearing the toner image is conveyed; turning on a heater to heat the fixing rotary body; conveying the recording medium bearing the toner image toward the fixing nip; calculating a reference time at which a trailing end portion of the recording medium in a conveyance direction of the recording medium reaches the fixing nip; and turning off the heater at a turn-off time earlier than the reference time.

Additional features and advantages of example embodiments will be more fully apparent from the following detailed description, the accompanying drawings, and the associated claims.

BRIEF DESCRIPTION OF THE SEVERAL VIEWS OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
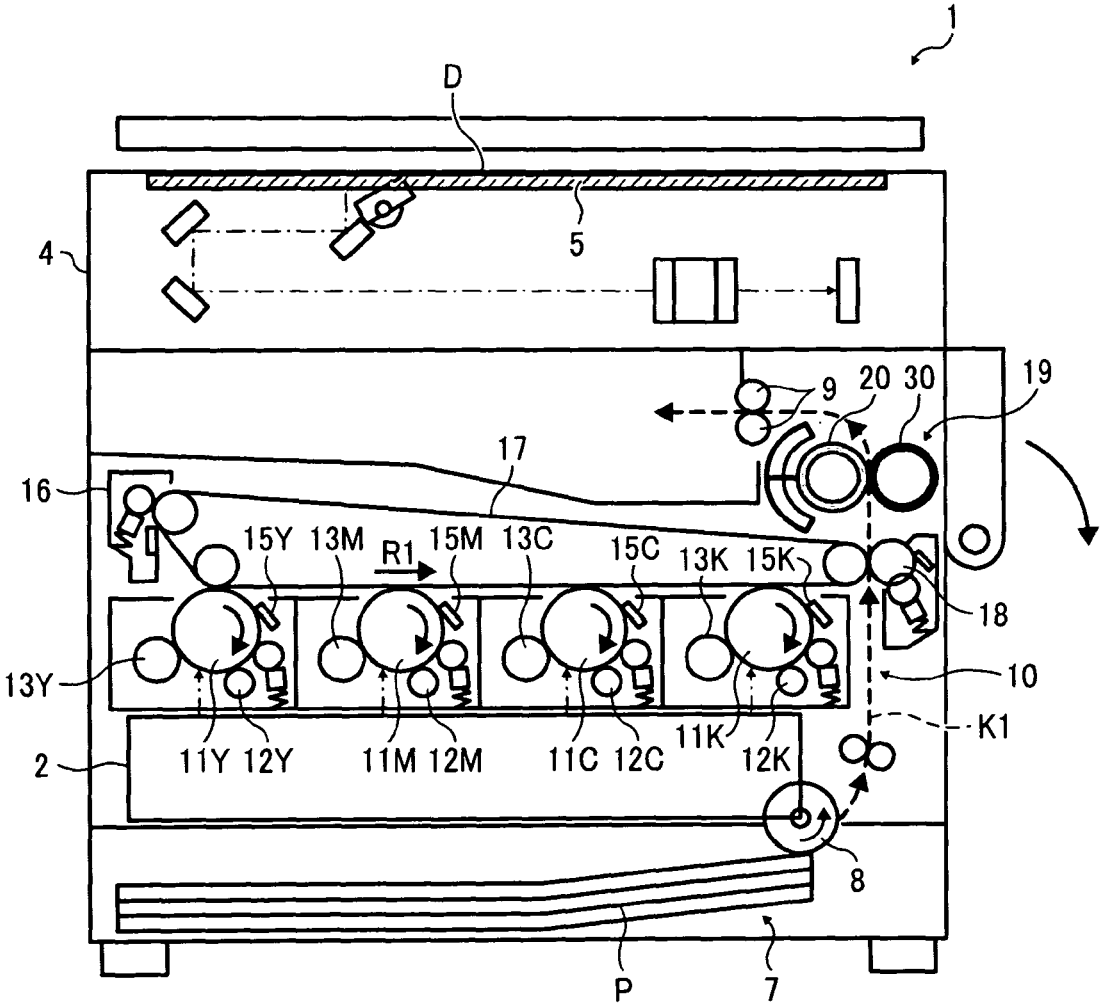
FIG. 1 is a schematic sectional view of an image foaming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, particularly to FIG. 1, an image forming apparatus 1 according to an example embodiment is explained.

FIG. 1 is a schematic sectional view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this example embodiment, the image forming apparatus 1 is a multifunction printer for forming a monochrome image and a color image on a recording medium by electrophotography.

Referring to FIG. 1, the following describes the structure of the image forming apparatus 1.

As illustrated in FIG. 1, the image forming apparatus 1 includes an original document reader 4 disposed in an upper portion of the image forming apparatus 1 and provided with an exposure glass 5. The original document reader 4 reads an image on an original document D placed on the exposure glass 5 and generates image data. Below the original document reader 4 is an image forming device 10 that includes a writer 2, photoconductive drums 11Y, 11M, 11C, and 11K, chargers 12Y, 12M, 12C, and 12K, development devices 13Y, 13M, 13C, and 13K, cleaners 15Y, 15M, 15C, and 15K, an intermediate transfer belt cleaner 16, an intermediate transfer belt 17, and a second transfer roller 18. For example, in a lower portion of the image forming apparatus 1 is the writer 2 that emits laser beams onto the photoconductive drums 11Y, 11M, 11C, and 11K surrounded by the chargers 12Y, 12M, 12C, and 12K, the development devices 13Y, 13M, 13C, and 13K, and the cleaners 15Y, 15M, 15C, and 15K, respectively. Specifically, the writer 2 emits the laser beams onto the photoconductive drums 11Y, 11M, 11C, and 11K charged by the chargers 12Y, 12M, 12C, and 12K according to the image data sent from the original document reader 4, thus forming electrostatic latent images on the photoconductive drums 11Y, 11M, 11C, and 11K. The development devices 13Y, 13M, 13C, and 13K visualize the electrostatic latent images formed on the photoconductive drums 11Y, 11M, 11C, and 11K with yellow, magenta, cyan, and black toners into yellow, magenta, cyan, and black toner images, respectively. The photoconductive drums 11Y, 11M, 11C, and 11K are disposed opposite transfer bias rollers that transfer the yellow, magenta, cyan, and black toner images from the photoconductive drums 11Y, 11M, 11C, and 11K onto the intermediate transfer belt 17 in such a manner that the yellow, magenta, cyan, and black toner images are superimposed on the same position on the intermediate transfer belt 17, thus producing a color toner image on the intermediate transfer belt 17. After the transfer of the yellow, magenta, cyan, and black toner images, the cleaners 15Y, 15M, 15C, and 15K collect residual toners from the photoconductive drums 11Y, 11M, 11C, and 11K, respectively. Specifically, the intermediate transfer belt 17, looped over the transfer bias rollers and other rollers including a driving roller, rotates in a rotation direction R1. Below the writer 2 is a paper tray 7 that contains a plurality of recording media P (e.g., transfer sheets). Above the paper tray 7 is a feed roller 8 that picks up and feeds a recording medium P from the paper tray 7 to a registration roller pair that feeds the recording medium P to a second transfer nip formed between the intermediate transfer belt 17 and the second transfer roller 18 at a proper time. As the recording medium P is conveyed through the second transfer nip, the second transfer roller 18 transfers the color toner image from the intermediate transfer belt 17 onto the recording medium P.

After the transfer of the color toner image from the intermediate transfer belt 17, the intermediate transfer belt cleaner 16 disposed opposite the intermediate transfer belt 17 cleans the intermediate transfer belt 17. Above the second transfer roller 18 is a fixing device 19 that fixes the color toner image on the recording medium P by heating the recording medium P by electromagnetic induction. Above the fixing device 19 is an output roller pair 9 that discharges the recording medium P bearing the fixed color toner image sent from the fixing device 19 onto an outside of the image forming apparatus 1.

Referring to FIG. 1, the following describes the operation of the image forming apparatus 1 having the above-described structure to form a color toner image on a recording medium P.

The original document reader 4 optically reads an image on the original document D placed on the exposure glass 5. For example, a lamp of the original document reader 4 emits a light beam onto the original document D bearing the image. The light beam reflected by the original document D travels to a color sensor through mirrors and a lens, where the image is formed. The color sensor reads and separates the image into red, green, and blue images, and converts the images into electric image signals for red, green, and blue. Based on the respective electric image signals, an image processor of the original document reader 4 performs processing such as color conversion, color correction, and space frequency correction, thus producing yellow, magenta, cyan, and black image data.

Thereafter, the yellow, magenta, cyan, and black image data are sent to the writer 2. The writer 2 emits laser beams onto the photoconductive drums 11Y, 11M, 11C, and 11K according to the yellow, magenta, cyan, and black image data sent from the original document reader 4.

A detailed description is now given of five processes performed on the photoconductive drums 11Y, 11M, 11C, and 11K, that is, a charging process, an exposure process, a development process, a first transfer process, and a cleaning process.

The four photoconductive drums 11Y, 11M, 11C, and 11K rotate clockwise in FIG. 1. In the charging process, the chargers 12Y, 12M, 12C, and 12K, disposed opposite the photoconductive drums 11Y, 11M, 11C, and 11K, uniformly charge an outer circumferential surface of the respective photoconductive drums 11Y, 11M, 11C, and 11K, thus generating a charging potential on the respective photoconductive drums 11Y, 11M, 11C, and 11K. Thereafter, the charged outer circumferential surface of the respective photoconductive drums 11Y, 11M, 11C, and 11K reaches a position where it receives a laser beam.

In the exposure process, four light sources of the writer 2, disposed opposite the photoconductive drums 11Y, 11M, 11C, and 11K, emit laser beams according to the yellow, magenta, cyan, and black image data, respectively. The laser beams corresponding to the yellow, magenta, cyan, and black image data travel through different optical paths, respectively. For example, the laser beam corresponding to the yellow image data irradiates the leftmost photoconductive drum 11Y in FIG. 1. Specifically, a polygon mirror of the writer 2, which rotates at a high speed, causes the laser beam corresponding to the yellow image data to scan the charged surface of the photoconductive drum 11Y in an axial direction of the photoconductive drum 11Y, that is, a main scanning direction. Thus, an electrostatic latent image is formed on the surface of the photoconductive drum 11Y charged by the charger 12Y according to the yellow image data.

Similarly, the laser beam corresponding to the magenta image data irradiates the second photoconductive drum 11M from the left in FIG. 1, forming an electrostatic latent image according to the magenta image data. The laser beam corresponding to the cyan image data irradiates the third photoconductive drum 11C from the left in FIG. 1, forming an electrostatic latent image according to the cyan image data. The laser beam corresponding to the black image data irradiates the rightmost photoconductive drum 11K in FIG. 1, forming an electrostatic latent image according to the black image data.

Thereafter, the outer circumferential surface of the respective photoconductive drums 11Y, 11M, 11C, and 11K formed with the electrostatic latent images reaches a position where the photoconductive drums 11Y, 11M, 11C, and 11K are disposed opposite the development devices 13Y, 13M, 13C, and 13K, respectively. In the development process, the development devices 13Y, 13M, 13C, and 13K, disposed opposite the photoconductive drums 11Y, 11M, 11C, and 11K, supply yellow, magenta, cyan, and black toners to the electrostatic latent images formed on the photoconductive drums 11Y, 11M, 11C, and 11K, respectively, thus rendering the electrostatic latent images visible as yellow, magenta, cyan, and black toner images.

Thereafter, the outer circumferential surface of the respective photoconductive drums 11Y, 11M, 11C, and 11K formed with the yellow, magenta, cyan, and black toner images reaches a position where the photoconductive drums 11Y, 11M, 11C, and 11K are disposed opposite the intermediate transfer belt 17. The four transfer bias rollers are disposed opposite the four photoconductive drums 11Y, 11M, 11C, and 11K, respectively, via the intermediate transfer belt 17 in a state in which the transfer bias rollers contact an inner circumferential surface of the intermediate transfer belt 17. In the first transfer process, the transfer bias rollers transfer the yellow, magenta, cyan, and black toner images from the photoconductive drums 11Y, 11M, 11C, and 11K onto an outer circumferential surface of the intermediate transfer belt 17 successively in such a manner that the yellow, magenta, cyan, and black toner images are superimposed on the same position on the intermediate transfer belt 17, thus producing a color toner image on the intermediate transfer belt 17.

Thereafter, the outer circumferential surface of the respective photoconductive drums 11Y, 11M, 11C, and 11K that no longer carry the yellow, magenta, cyan, and black toner images reaches a position where the photoconductive drums 11Y, 11M, 11C, and 11K are disposed opposite the cleaners 15Y, 15M, 15C, and 15K, respectively. In the cleaning process, the cleaners 15Y, 15M, 15C, and 15K, disposed opposite the photoconductive drums 11Y, 11M, 11C, and 11K, collect residual toners not transferred and therefore remaining on the photoconductive drums 11Y, 11M, 11C, and 11K from the photoconductive drums 11Y, 11M, 11C, and 11K, respectively.

Thereafter, dischargers disposed opposite the photoconductive drums 11Y, 11M, 11C, and 11K discharge the outer circumferential surface of the respective photoconductive drums 11Y, 11M, 11C, and 11K, thus completing a series of processes performed on the photoconductive drums 11Y, 11M, 11C, and 11K.

A detailed description is now given of two processes performed on the intermediate transfer belt 17, that is, a second transfer process and a cleaning process.

The outer circumferential surface of the intermediate transfer belt 17 transferred with the color toner image reaches a position where it is disposed opposite the second transfer roller 18, that is, the second transfer nip. Specifically, the second transfer nip is created by the second transfer roller 18 and a second transfer backup roller that sandwich the intermediate transfer belt 17. As a recording medium P sent from the paper tray 7 passes through the second transfer nip, the color toner image formed on the intermediate transfer belt 17 is transferred onto the recording medium P in the second transfer process. After the transfer of the color toner image from the intermediate transfer belt 17, residual toner not transferred onto the recording medium P remains on the intermediate transfer belt 17.

Thereafter, the outer circumferential surface of the intermediate transfer belt 17 that no longer carries the color toner image reaches a position where it is disposed opposite the intermediate transfer belt cleaner 16. The intermediate transfer belt cleaner 16 collects the residual toner from the intermediate transfer belt 17 in the cleaning process, thus completing a series of processes performed on the intermediate transfer belt 17.

A detailed description is now given of two processes performed on the recording medium P, that is, the second transfer process described above and a fixing process.

The recording medium P is conveyed from the paper tray 7 disposed in the lower portion of the image forming apparatus 1 to the second transfer nip through a conveyance path K1 provided with the feed roller 8 and the registration roller pair. For example, the paper tray 7 contains a plurality of recording media P. As the feed roller 8 rotates counterclockwise in FIG. 1, the feed roller 8 feeds an uppermost recording medium P to the conveyance path K1.

The recording medium P conveyed to the conveyance path K1 is stopped temporarily by the registration roller pair at a nip formed between two rollers of the registration roller pair. When the registration roller pair resumes rotating, the registration roller pair feeds the recording medium P to the second transfer nip at a proper time for transferring the color toner image formed on the intermediate transfer belt 17 onto the recording medium P. Thus, a desired color toner image is transferred onto the recording medium P in the second transfer process described above.

Thereafter, the recording medium P bearing the color toner image is sent to the fixing device 19 where a fixing roller 20 and a pressing roller 30 apply heat and pressure to the recording medium P to fix the color toner image on the recording medium P in the fixing process. Then, the output roller pair 9 disposed downstream from the fixing device 19 in a conveyance direction of the recording medium P discharges the recording medium P bearing the fixed color toner image in a direction indicated by the broken line arrow onto the outside of the image forming apparatus 1, thus completing a series of processes for forming the color toner image on the recording medium P.

Figure 2:
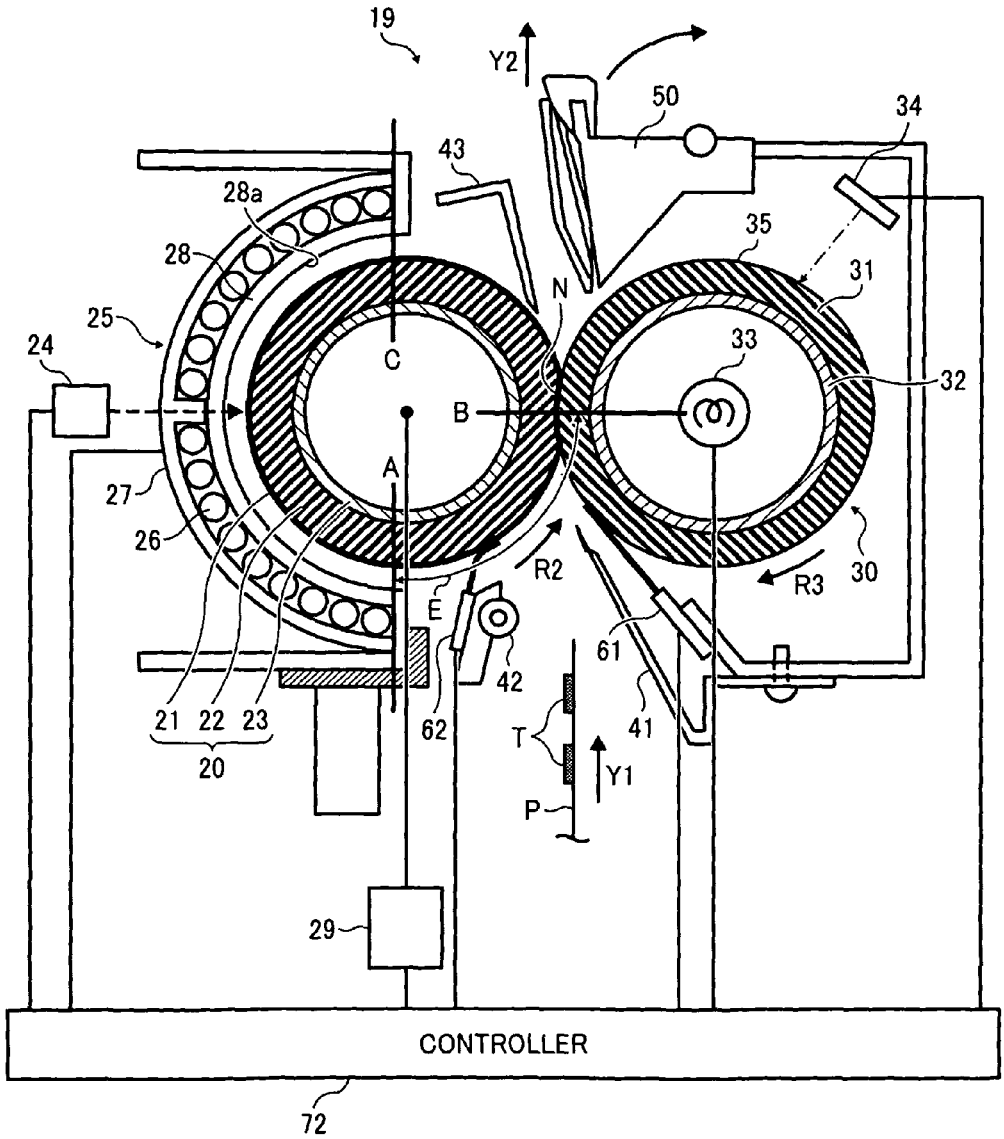
FIG. 2 is a vertical sectional view of a fixing device installed in the image forming apparatus shown in FIG. 1.
Figure 3:
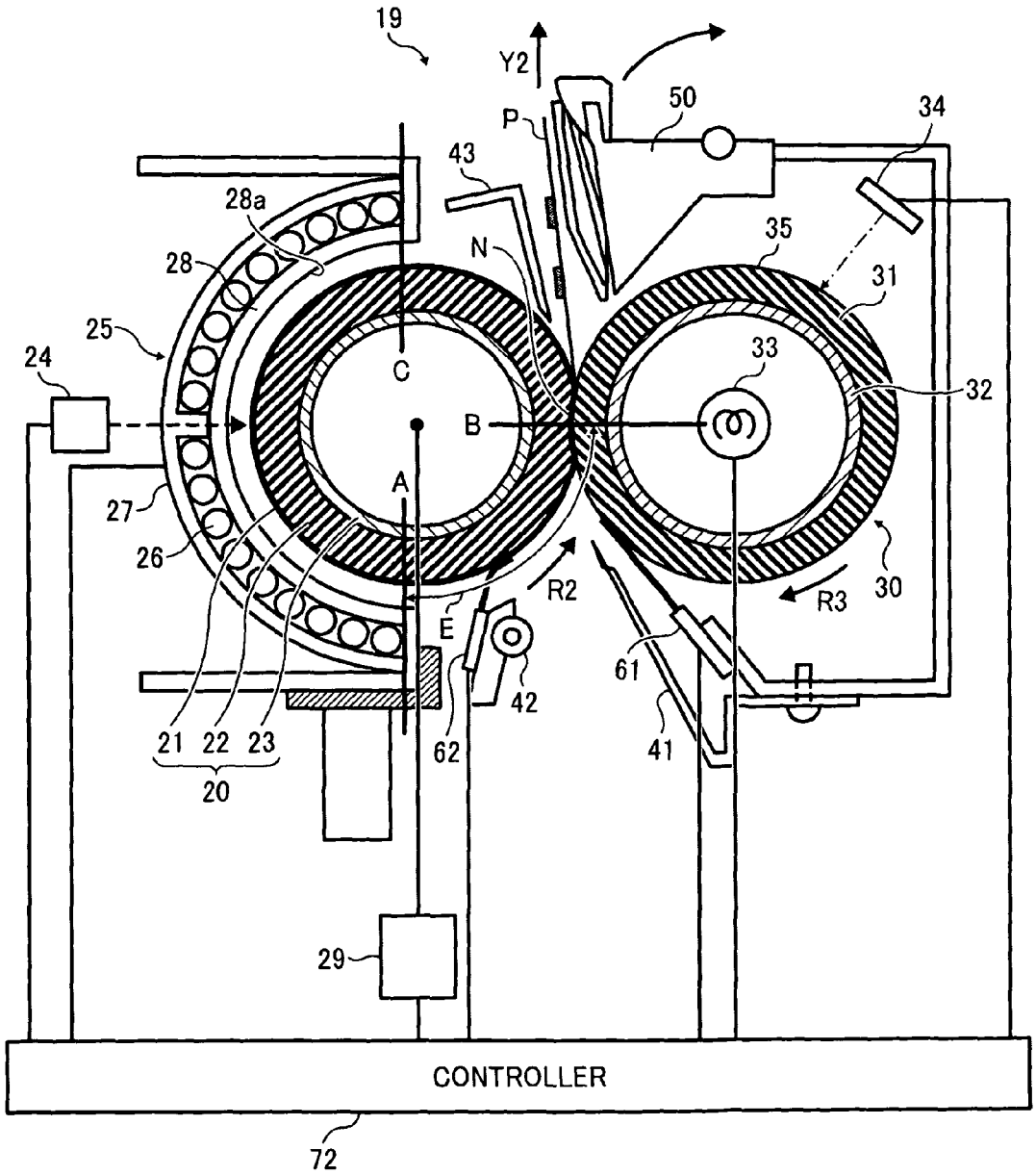
FIG. 3 is a vertical sectional view of the fixing device shown in FIG. 2.

Referring to FIGS. 2 and 3, the following describes the structure and operation of the fixing device 19 installed in the image forming apparatus 1 described above.

FIG. 2 is a vertical sectional view of the fixing device 19 before the recording medium P passes between the fixing roller 20 and the pressing roller 30. FIG. 3 is a vertical sectional view of the fixing device 19 after the recording medium P passes between the fixing roller 20 and the pressing roller 30.

As illustrated in FIG. 2, the fixing device 19 (e.g., a fuser unit) includes the fixing roller 20 serving as a fixing rotary body; the pressing roller 30 serving as a pressing rotary body pressed against the fixing roller 20 to form a fixing nip N therebetween through which a recording medium P bearing a toner image T passes; an induction heater 25 serving as a magnetic flux generator or a heater disposed opposite the fixing roller 20; an entrance guide 41 (e.g., a plate) disposed upstream from the fixing nip N in the conveyance direction of the recording medium P; a spur guide 42 (e.g., a plate) disposed opposite the entrance guide 41 and upstream from the fixing nip N in the conveyance direction of the recording medium P; a separation guide 43 (e.g., a plate) disposed downstream from the fixing nip N in the conveyance direction of the recording medium P; an exit guide 50 (e.g., a plate) disposed opposite the separation guide 43 and downstream from the fixing nip N in the conveyance direction of the recording medium P; a thermistor 61 disposed upstream from the fixing nip N in the conveyance direction of the recording medium P and contacting the pressing roller 30; and a thermistor 62 disposed upstream from the fixing nip N in the conveyance direction of the recording medium P and contacting the fixing roller 20.

A detailed description is now given of the fixing roller 20.

The fixing roller 20 having an outer diameter of about 34 mm is constructed of three layers: a metal core 23 made of iron, stainless steel, or the like; a heat insulating elastic layer 22 disposed on the metal core 23 and made of silicone rubber foam or the like; and a sleeve layer 21 disposed on the heat insulating elastic layer 22.

The sleeve layer 21 has a multilayer structure constructed of a base layer constituting an inner circumferential surface, a first antioxidant layer disposed on the base layer, a heat generating layer disposed on the first antioxidant layer, a second antioxidant layer disposed on the heat generating layer, an elastic layer disposed on the second antioxidant layer, and a release layer disposed on the elastic layer. For example, the base layer is made of stainless steel or the like. The first antioxidant layer and the second antioxidant layer are treated with nickel strike plating. The heat generating layer having a thickness of about 15 micrometers is made of copper or the like. The elastic layer having a thickness of about 200 micrometers is made of silicone rubber or the like. The release layer having a thickness of about 30 micrometers is made of tetrafluoroethylene-perfluoroalkylvinylether copolymer (PFA) or the like.

With the above-described structure, the heat generating layer of the sleeve layer 21 of the fixing roller 20 is heated by electromagnetic induction by a magnetic flux generated by the induction heater 25. It is to be noted that the structure of the fixing roller 20 is not limited to the above. For example, the sleeve layer 21 may be separately provided from the heat insulating elastic layer 22 by not being adhered to the heat insulating elastic layer 22. In this case, the sleeve layer 21 serves as a fixing sleeve and the heat insulating elastic layer 22 serves as a supplemental fixing roller. Further, it is preferable that the fixing roller 20 may further include a mechanism that prevents the sleeve layer 21 from shifting from the heat insulating elastic layer 22 in an axial direction, that is, a thrust direction, of the fixing roller 20 as the fixing roller 20 rotates.

A detailed description is now given of the components surrounding the fixing roller 20.

The spur guide 42 is disposed opposite the fixing roller 20 and upstream from the fixing nip N in the conveyance direction of the recording medium P. The spur guide 42 includes a plurality of spurs arranged in the axial direction of the fixing roller 20. The spur guide 42 is disposed opposite an image side (e.g., a front side) of the recording medium P bearing the unfixed toner image T conveyed toward the fixing nip N, guiding the recording medium P to the fixing nip N. The plurality of spurs of the spur guide 42 has a sawtooth circumferential surface portion to prevent the plurality of spurs from scratching and damaging the unfixed toner image T on the recording medium P when the plurality of spurs contacts the image side of the recording medium P.

The separation guide 43 is disposed opposite the fixing roller 20 and downstream from the fixing nip N in the conveyance direction of the recording medium P. The separation guide 43 is disposed opposite the image side of the recording medium P conveyed from the fixing nip N. The separation guide 43 prevents the recording medium P bearing the fixed toner image T from being attracted and adhered to the fixing roller 20 as the recording medium P is discharged from the fixing nip N. For example, the separation guide 43 contacts a leading edge of the recording medium P and separates the recording medium P from the fixing roller 20.

The thermistor 62 is disposed in proximity to and upstream from the fixing nip N in the conveyance direction of the recording medium P. The thermistor 62 serving as a contact temperature detecting sensor contacts the fixing roller 20 at one lateral end of the fixing roller 20 in the axial direction thereof where the fixing roller 20 is driven, thus detecting a surface temperature of the fixing roller 20.

A thermopile 24 serving as a non-contact temperature detecting sensor is disposed opposite the fixing roller 20 at a center of the fixing roller 20 in the axial direction thereof.

The thermistor 62 and the thermopile 24 described above detect the temperature of the fixing roller 20, that is, a fixing temperature at which the toner image T is fixed on the recording medium P. The thermistor 62 and the thermopile 24 are operatively connected to a controller 72, that is, a central processing unit (CPU) provided with a random-access memory (RAM) and a read-only memory (ROM), for example. The controller 72 is operatively connected to the induction heater 25 to control the induction heater 25 to adjust a heating amount of the induction heater 25 that heats the fixing roller 20 based on the temperature of the fixing roller 20 detected by the thermistor 62 and the thermopile 24. According to this example embodiment, the controller 72 controls the induction heater 25 to heat the fixing roller 20 to the temperature in a range of from about 160 degrees centigrade to about 165 degrees centigrade during the fixing process, that is, when the recording medium P bearing the toner image T passes through the fixing nip N.

As shown in FIG. 2, the pressing roller 30 having an outer diameter of about 32 mm is constructed of three layers: a cylindrical core 32 made of aluminum, copper, or the like; an elastic layer 31 disposed on the core 32 and made of silicone rubber or the like; and a release layer 35 disposed on the elastic layer 31 and made of PFA or the like. The elastic layer 31 has a thickness in a range of from about 1 mm to about 5 mm. The release layer 35 has a thickness in a range of from about 20 micrometers to about 50 micrometers.

A moving assembly presses the pressing roller 30 against the fixing roller 20 to form the fixing nip N therebetween through which the recording medium P bearing the toner image T passes.

According to this example embodiment shown in FIG. 2, a heater 33 (e.g., a halogen heater) is disposed inside the pressing roller 30 to heat the fixing roller 20 more effectively. For example, when power is supplied to the heater 33, the heater 33 emits radiation heat to heat the pressing roller 30. Then, the pressing roller 30 heats the fixing roller 20.

A detailed description is now given of the components surrounding the pressing roller 30.

The thermistor 61 is disposed in proximity to and upstream from the fixing nip N in the conveyance direction of the recording medium P. The thermistor 61 serves as a contact temperature detecting sensor that contacts the pressing roller 30 at one lateral end of the pressing roller 30 in an axial direction thereof where the pressing roller 30 is driven, thus detecting a surface temperature of the pressing roller 30.

A thermopile 34 is disposed opposite the pressing roller 30 at a center of the pressing roller 30 in the axial direction thereof and serves as a non-contact temperature detecting sensor that detects the temperature of the pressing roller 30 without contacting the pressing roller 30.

The thermistor 61 and the thermopile 34 described above detect the temperature of the pressing roller 30. The thermistor 61 and the thermopile 34 are operatively connected to the controller 72 that is operatively connected to the heater 33 to control the heater 33 to adjust a heating amount of the heater 33 that heats the pressing roller 30 based on the temperature of the pressing roller 30 detected by the thermistor 61 and the thermopile 34.

The entry guide 41 is disposed upstream from the fixing nip N in the conveyance direction of the recording medium P. The entry guide 41 is disposed opposite the pressing roller 30 and a non-image side (e.g., a back side) of the recording medium P not bearing the unfixed toner image T conveyed toward the fixing nip N, thus guiding the recording medium P to the fixing nip N. It is to be noted that the non-image side of the recording medium P defines a side of the recording medium P that bears no toner image or bears the fixed toner image in duplex printing.

The exit guide 50 is disposed downstream from the fixing nip N in the conveyance direction of the recording medium P. The exit guide 50 is disposed opposite the pressing roller 30 and the non-image side of the recording medium P discharged from the fixing nip N, thus guiding the recording medium P bearing the fixed toner image T discharged from the fixing nip N to a conveyance path disposed downstream from the fixing device 19 in the conveyance direction of the recording medium P.

A detailed description is now given of the induction heater 25.

The induction heater 25 is disposed opposite the fixing roller 20 at a face of the fixing roller 20 opposite a face thereof where the pressing roller 30 is disposed opposite the fixing roller 20. The induction heater 25 includes a coil 26 (e.g., an exciting coil), a core 27 (e.g., an exciting coil core), and a coil guide 28.

The coil 26 includes litz wire made of bundled thin wire wound around the coil guide 28 that covers a part of an outer circumferential surface of the fixing roller 20 and extending in the axial direction of the fixing roller 20.

The coil guide 28 is made of a heat resistant resin such as polyethylene-terephthalate (PET) that contains glass at a rate of about 45 percent. The coil guide 28 is disposed opposite the fixing roller 20 to hold the coil 26 with respect to the outer circumferential surface of the fixing roller 20. According to this example embodiment, a gap in a range of from about 1.9 mm to about 2.1 mm is provided between the outer circumferential surface of the fixing roller 20 and an inner circumferential surface 28*a* of the coil guide 28 that faces the outer circumferential surface of the fixing roller 20.

The core 27 is made of ferromagnet such as ferrite having a magnetic permeability of about 2,500 and includes an arc core, a center core, and a side core to generate magnetic fluxes toward the heat generating layer of the fixing roller 20 effectively.

Referring to FIG. 2, the following describes the operation of the fixing device 19 having the above-described structure.

A driver 29 (e.g., a motor) drives and rotates the fixing roller 20 counterclockwise in FIG. 2 in a rotation direction R2. The rotating fixing roller 20 rotates the pressing roller 30 clockwise in FIG. 2 in a rotation direction R3 counter to the rotation direction R2 of the fixing roller 20. The induction heater 25 disposed opposite the fixing roller 20 generates a magnetic flux to heat the heat generating layer of the sleeve layer 21 of the fixing roller 20.

For example, a frequency variable power supply of an oscillator circuit sends a high frequency alternating current in a range of from about 10 kHz to about 1 MHz, preferably in a range of from about 20 kHz to about 800 kHz, to the coil 26. Accordingly, the coil 26 generates magnetic lines of force alternately switched bidirectionally toward the sleeve layer 21 of the fixing roller 20, thus generating an alternating magnetic field. The alternating magnetic field generates an eddy current in the heat generating layer of the sleeve layer 21, which causes the heat generating layer to generate Joule heat by its electric resistance. Thus, the sleeve layer 21 heats itself by induction heating of the heat generating layer thereof.

Thereafter, as the fixing roller 20 rotates, a portion of the outer circumferential surface of the fixing roller 20 heated by the induction heater 25 reaches the fixing nip N formed between the fixing roller 20 and the pressing roller 30 contacting each other.

Accordingly, the fixing roller 20 heats and melts the toner image T on the recording medium P conveyed through the fixing nip N.

For example, the recording medium P bearing the toner image T formed by the above-described image forming processes is conveyed in a direction Y1 to the fixing nip N while guided by the entry guide 41 or the spur guide 42. As the recording medium P bearing the toner image T passes through the fixing nip N, the heated portion of the fixing roller 20 heats the recording medium P and at the same time the pressing roller 30 applies pressure to the recording medium P, thus melting and fixing the toner image T on the recording medium P. Then, the recording medium P is discharged from the fixing nip N and is conveyed in a direction Y2. After the recording medium P bearing the fixed toner image T is discharged from the fixing nip N, the heated portion of the fixing roller 20 having passed through the fixing nip N and now cooled by the recording medium P returns to an opposed position where the fixing roller 20 is disposed opposite the induction heater 25. A series of the above-described operations is repeated, thus completing the fixing process of the image forming processes described above.

Referring to FIGS. 2 to 6, the following describes a control method for controlling the temperature of the fixing roller 20 according to a first embodiment which may be performed when the last recording medium P is conveyed through the fixing device 19 in a particular print job.

Figure 4:
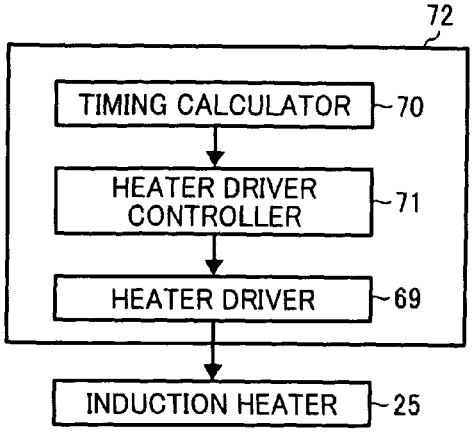
FIG. 4 is a block diagram of a controller and an induction heater installed in the fixing device shown in FIG. 2.

FIG. 4 is a block diagram of the controller 72 and the induction heater 25. As illustrated in FIG. 4, the controller 72 includes a heater driver 69 operatively connected to the induction heater 25 to turn on the induction heater 25; a heater driver controller 71 operatively connected to the heater driver 69 to control the heater driver 69; and a timing calculator 70 operatively connected to the heater driver controller 71.

As recording media P of a particular print job pass through the fixing nip N formed between the fixing roller 20 and the pressing roller 30, the recording media P draw heat from the fixing roller 20. Accordingly, when the last recording medium P of the print job is discharged from the fixing nip N, the fixing roller 20 has been cooled to a temperature lower than a predetermined fixing temperature. To address this circumstance, the heater driver 69 turns on the induction heater 25 to heat the fixing roller 20. By contrast, when the temperature of the fixing roller 20 is higher than the predetermined fixing temperature, the heater driver 69 turns off the induction heater 25 to cool the fixing roller 20. Thus, the heater driver 69 turns on and off the induction heater 25 to maintain the fixing roller 20 at the predetermined fixing temperature.

Figure 5:
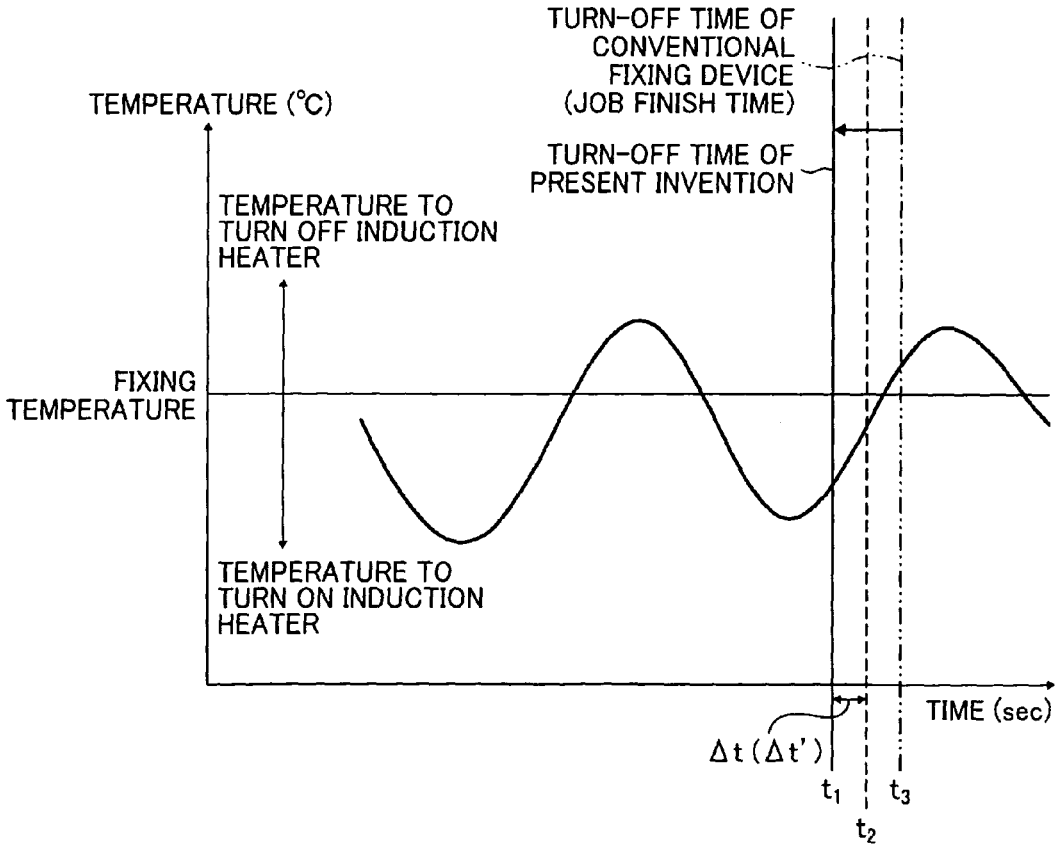
FIG. 5 is a graph showing a relation between time and a temperature of a fixing roller of the fixing device shown in FIG. 2.

Referring to FIG. 5, a detailed description is now given of such operation of the heater driver 69.

FIG. 5 is a graph showing a relation between time and the temperature of the fixing roller 20. In FIG. 5, a horizontal axis represents time and a vertical axis represents the surface temperature of the fixing roller 20.

A time t3 indicated by the chain double-dashed line defines a time at which a trailing edge of the recording medium P is discharged from the fixing nip N. The trailing edge of the recording medium P is a part of the recording medium P that passes through the fixing nip N last. Conventionally, when the surface temperature of the fixing roller 20 is lower than the predetermined fixing temperature and therefore the induction heater 25 needs to be turned on at a time prior to the time t3, the induction heater 25 remains on. Accordingly, the induction heater 25 heats the fixing roller 20 even at a section on the fixing roller 20 downstream from the trailing edge of the recording medium P in the conveyance direction of the recording medium P, wasting power.

To address this problem, according to the first embodiment of the present invention, the timing calculator 70 depicted in FIG. 4 obtains information about the trailing edge of the recording medium P. The heater driver controller 71 controls the heater driver 69 based on the information obtained by the timing calculator 70 to turn off the induction heater 25.

Specifically, the timing calculator 70 obtains information about a feeding time at which the second transfer roller 18 depicted in FIG. 1 feeds the recording medium P toward the fixing device 19, calculates a time t2, that is, a reference time, indicated by the broken line in FIG. 5 at which the trailing edge of the recording medium P reaches the fixing nip N based on that information, and sends the calculated time t2 to the heater driver controller 71.

The heater driver controller 71 determines whether or not the trailing edge of the recording medium P reaches the fixing nip N based on the calculated time t2 sent from the timing calculator 70. If the heater driver controller 71 determines that the trailing edge of the recording medium P has not reached the fixing nip N as shown in FIG. 2, that is, the time t2 has not yet been reached, the heater driver controller 71 forcibly turns off the induction heater 25 so that the trailing edge of the recording medium P reaches the fixing nip N while the induction heater 25 is turned off. For example, the heater driver controller 71 controls the heater driver 69 so that the heater driver 69 turns off the induction heater 25 at a time t1, that is, a turn-off time, indicated by the solid line in FIG. 5 prior to the time t2. The time t1 is determined based on the time t2 calculated according to information about a feeding time at which the second transfer roller 18 depicted in FIG. 1 feeds the recording medium P toward the fixing device 19 or a writing time at which the writer 2 depicted in FIG. 1 writes an electrostatic latent image on the respective photoconductive drums 11Y, 11M, 11C, and 11K, which may vary depending on the size and conveyance speed of the recording medium P.

According to the first embodiment, the time t1 is prior to the time t2 at which the trailing edge of the recording medium P reaches the fixing nip N by a predetermined time period Δt, which correspond to the time required for a heated portion of the rotating fixing roller 20 heated at a position A shown in FIG. 2 by the induction heater 25 to reach a position B disposed at a center of the fixing nip N in the rotation direction R2 of the fixing roller 20.

Specifically, as shown in FIG. 2, given its configuration and disposition, the induction heater 25 starts heating a particular section on the outer circumferential surface of the rotating fixing roller 20 when the particular section is at a position C and finishes heating the particular section when the particular section reaches the position A. A predetermined circumferential distance E is provided along the circumferential surface of the fixing roller 20 between the position A and the position B in the rotation direction R2 of the fixing roller 20. Thus, it takes the predetermined time period Δt for the particular section of the fixing roller 20 to rotate the predetermined circumferential distance E, that is, to move from the position A to the position B.

As shown in FIG. 5, even when the induction heater 25 should heat the fixing roller 20 at the time t1, that is, even when the surface temperature of the fixing roller 20 is lower than the predetermined fixing temperature at the time t1, the heater driver controller 71 causes the heater driver 69 to turn off the induction heater 25. When the particular section of the fixing roller 20 heated by the induction heater 25 at the position A reaches the position B, the trailing edge of the recording medium P also reaches the position B, which corresponds substantially to the position of the fixing nip N. That is, a time at which the particular section of the fixing roller 20 reaches the position B is substantially coincident with a time at which the trailing edge of the recording medium P reaches the position B. Accordingly, the trailing edge of the recording medium P is contacted by the heated, particular section of the fixing roller 20 as the trailing edge of the recording medium P is conveyed through the fixing nip N. Thus, the fixing roller 20 can heat the recording medium P until the trailing edge of the recording medium P is discharged from the fixing nip N. Consequently, the fixing roller 20 can melt and fix the toner image T on the recording medium P properly. Simultaneously, the induction heater 25 does not unnecessarily heat a downstream section of the fixing roller 20 that is downstream from the particular section of the fixing roller 20 in the rotation direction R2 thereof and need not be heated by the induction heater 25 because the downstream section of the fixing roller 20 reaches the position B after the trailing edge of the recording medium P is discharged from the fixing nip N.

After the heater driver controller 71 turns off the induction heater 25 via the heater driver 69, the heater driver 69 does not turn on the induction heater 25 again. That is, the induction heater 25 remains off.

Figure 6:
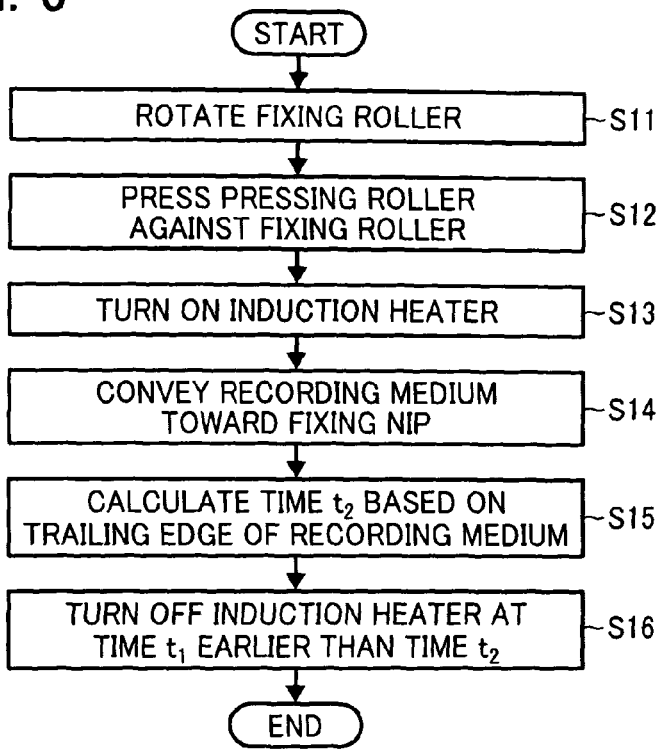
FIG. 6 is a flowchart showing processes of a control method according to a first embodiment performed by the controller shown in FIG. 4.

Referring to FIGS. 2, 4, and 6, the following describes processes of the control method according to the first embodiment described above.

FIG. 6 is a flowchart showing the processes of the control method according to the first embodiment.

In step S11, the driver 29 rotates the fixing roller 20 in the rotation direction R2. In step S12, the pressing roller 30 is pressed against the fixing roller 20 to form the fixing nip N therebetween. Accordingly, the rotating fixing roller 20 rotates the pressing roller 30 by friction therebetween. In step S13, the heater driver 69 turns on the induction heater 25 to heat the fixing roller 20. In step S14, the recording medium P is conveyed toward the fixing nip N. In step S15, the timing calculator 70 calculates the time t2 at which the trailing edge of the recording medium P in the conveyance direction of the recording medium P reaches the position B of the fixing nip N. In step S16, the heater driver controller 71 causes the heater driver 69 to turn off the induction heater 25 at the time t1 earlier than the time t2 by the predetermined time period Δt.

According to the first embodiment, the fixing roller 20 has an outer diameter of about 34 mm and rotates at a linear velocity of about 154 mm/s. With this configuration, the fixing roller 20 moves from the position A to the position B in about 200 ms. If the fixing roller 20 rotates at a lower linear velocity of about 77 mm/s, the fixing roller 20 moves from the position A to the position B in about 400 ms.

A sensor detecting that the trailing edge of the recording medium P is discharged from the fixing nip N is disposed at a position downstream from the fixing nip N by about 100 mm in the conveyance direction of the recording medium P. It takes about 400 ms for the recording medium P moving at a linear velocity of about 154 mm/s to move from the fixing nip N to the sensor. It takes about 800 ms for the recording medium P moving at a linear velocity of about 77 minis to move from the fixing nip N to the sensor. Accordingly, with the above-described configuration of the first embodiment, the induction heater 25 is turned off about 600 ms earlier at the linear velocity of about 154 mm/s of the fixing roller 20 and about 1,200 ms earlier at the linear velocity of about 77 mm/s of the fixing roller 20 than with the conventional configurations.

As described above, with the structure of the fixing device 19 shown in FIGS. 2 to 4 and the control method thereof shown in FIG. 5 according to the first embodiment, when the timing calculator 70 determines that the trailing edge of the recording medium P does not reach the fixing nip N yet, the heater driver controller 71 controls the heater driver 69 so that the heater driver 69 turns off the induction heater 25 before the trailing edge of the recording medium P reaches the fixing nip N. There is the predetermined time period Δt until the particular section on the outer circumferential surface of the fixing roller 20 last heated by the induction heater 25 at the position A reaches the position B of the fixing nip N. The heater driver controller 71 causes the heater driver 69 to turn off the induction heater 25 by the predetermined time period Δt earlier than the time at which the trailing edge of the recording medium P reaches the position B. Accordingly, a time at which a particular section of the fixing roller 20 heated by the induction heater 25 at the position A reaches the position B is substantially coincident with a time at which the trailing edge of the recording medium P reaches the position B. Consequently, the induction heater 25 does not unnecessarily heat a section of the fixing roller 20 that is not to contact the recording medium P at the fixing nip N, minimizing waste of power not used for fixing the toner image T on the recording medium P. That is, the fixing device 19 completes the fixing process with minimum required amount of power, thus reducing power consumption.

The heater driver controller 71 causes the heater driver 69 to turn off the induction heater 25 at the time t1 by the predetermined time period Δt earlier than the time t2 at which the trailing edge of the recording medium P reaches the position B of the fixing nip N, thus minimizing power precisely.

Referring to FIGS. 2 to 5 and 7, the following describes a second embodiment of the present invention. The second embodiment uses the structure of the fixing device 19 depicted in FIGS. 2 to 4 but employs a control method different from that of the first embodiment described above.

For example, the heater driver controller 71 causes the heater driver 69 to turn off the induction heater 25 at a time by a predetermined time period Δt' earlier than a time at which a trailing end of a toner image T on the last recording medium P in a print job in the conveyance direction of the recording medium P reaches the position B of the fixing nip N. The predetermined time period Δt' is a time period required for a particular section on the outer circumferential surface of the fixing roller 20 heated by the induction heater 25 at the position A to reach the position B of the fixing nip N. It is to be noted that the timing calculator 70 calculates the predetermined time period Δt' based on the trailing end of the toner image T on the recording medium P, not the trailing edge of the recording medium P as in the first embodiment. Namely, the heater driver controller 71 turns off the induction heater 25 via the heater driver 69 at the time by the predetermined time period Δt' earlier than the time at which the trailing end of the toner image T on the recording medium P reaches the position B of the fixing nip N regardless of the size of the recording medium P. With this configuration, when the heated, particular section of the fixing roller 20 heated at the position A reaches the position B of the fixing nip N, the trailing end of the toner image T on the recording medium P in the conveyance direction of the recording medium P also reaches the position B of the fixing nip N.

That is, a time at which a particular section of the fixing roller 20 heated by the induction heater 25 at the position A reaches the position B of the fixing nip N is substantially coincident with a time at which the trailing end of the toner image T on the recording medium P in the conveyance direction of the recording medium P reaches the position B of the fixing nip N. Accordingly, the trailing end of the toner image T on the recording medium P is contacted by the heated, particular section of the fixing roller 20 as the trailing end of the toner image T on the recording medium P is conveyed through the fixing nip N. Thus, the fixing roller 20 can heat the recording medium P until the trailing end of the toner image T on the recording medium P is discharged from the fixing nip N. Consequently, the fixing roller 20 can melt and fix the toner image T on the recording medium P properly. Simultaneously, the induction heater 25 does not unnecessarily heat a downstream section of the fixing roller 20 that is downstream from the particular section of the fixing roller 20 in the rotation direction R2 thereof and need not be heated by the induction heater 25 because the downstream section of the fixing roller 20 reaches the position B after the trailing end of the toner image T on the recording medium P is discharged from the fixing nip N.

Referring to FIGS. 2 to 5 and 7, the following describes processes of the control method according to the second embodiment described above.

Figure 7:
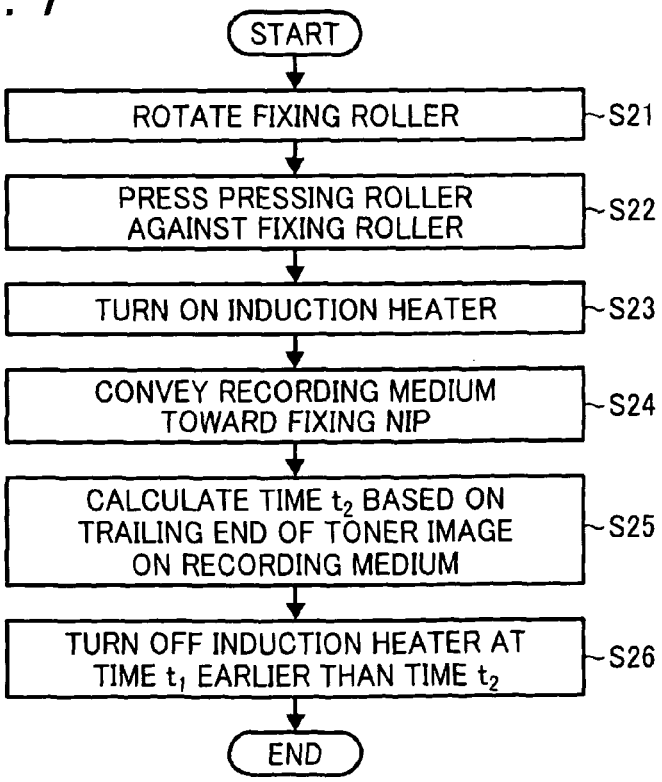
FIG. 7 is a flowchart showing processes of a control method according to a second embodiment performed by the controller shown in FIG. 4.

FIG. 7 is a flowchart showing the processes of the control method according to the second embodiment.

In step S21, the driver 29 rotates the fixing roller 20 in the rotation direction R2. In step S22, the pressing roller 30 is pressed against the fixing roller 20 to form the fixing nip N therebetween. Accordingly, the rotating fixing roller 20 rotates the pressing roller 30 in the rotation direction R3 by friction therebetween. In step S23, the heater driver 69 turns on the induction heater 25 to heat the fixing roller 20. In step S24, the recording medium P is conveyed toward the fixing nip N. In step S25, the timing calculator 70 calculates the time t2 at which the trailing end of the toner image T on the recording medium P in the conveyance direction of the recording medium P reaches the position B of the fixing nip N. In step S26, the heater driver controller 71 causes the heater driver 69 to turn off the induction heater 25 at the time t1 earlier than the time t2 by the predetermined time period Δt'.

As described above, the second embodiment can attain the same advantages as the first embodiment. For example, the heater driver controller 71 causes the heater driver 69 to turn off the induction heater 25 at the time t1 by the predetermined time period Δt' earlier than the time t2 at which the trailing end of the toner image T on the recording medium P reaches the position B of the fixing nip N. The advantages of this configuration are significant if the recording medium P bears a toner image T only at a leading edge thereof in the conveyance direction of the recording medium P or if a blank recording medium P is conveyed through the fixing nip N.

It is to be noted that the timing calculator 70 obtains information about a writing time at which the writer 2 depicted in FIG. 1 writes an electrostatic latent image on the respective photoconductive drums 11Y, 11M, 11C, and 11K, calculates the time t2 at which the trailing end of the toner image T on the recording medium P reaches the fixing nip N based on that information, and sends the calculated time t2 to the heater driver controller 71. Additionally, the timing calculator 70 may obtain a feeding time at which the second transfer roller 18 depicted in FIG. 1 feeds the recording medium P toward the fixing device 19.

The present invention has been described above with reference to specific embodiments illustrated in the drawings. Nonetheless, the present invention is not limited to the details of embodiments described above, but various modifications and improvements are possible without departing from the spirit and scope of the present invention. For example, according to the above-described embodiments, the image forming apparatus 1 depicted in FIG. 1 is a multifunction printer having at least one of copying, printing, scanning, plotter, and facsimile functions, or the like. Alternatively, the image forming apparatus 1 may be a copier, a facsimile machine, a printer, or the like. Further, according to the above-described embodiments, the induction heater 25 is disposed outside the fixing roller 20. Alternatively, the induction heater 25 may be disposed inside the fixing roller 20. Moreover, the first and second embodiments are described above by referring to the last recording medium P of recording media P printed in a print job. Alternatively, the control method of the first and second embodiments may be employed with any recording medium other than the last recording medium of a print job or all recording media of a print job. Further, the control method of the first and second embodiments may be performed periodically in the fixing process or whenever the predetermined number of recording media is printed.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device, comprising:

a fixing rotary body rotatable in a set direction of rotation;

a pressing rotary body disposed parallel to and pressed against the fixing rotary body to form a fixing nip therebetween through which a recording medium bearing a toner image is conveyed;

a heater to heat the fixing rotary body, disposed opposite a circumferential surface of the fixing rotary body and upstream from the fixing nip a set circumferential distance along the circumferential surface of the fixing rotary body in the direction of rotation of the fixing rotary body;

a heater driver operatively connected to the heater to turn on and off the heater;

a timing calculator to calculate a reference time at which a trailing end portion of the recording medium in a conveyance direction of the recording medium reaches the fixing nip; and a heater driver controller operatively connected to the timing calculator and the heater driver to cause the heater driver to turn off the heater at a turn-off time earlier than the reference time calculated by the timing calculator, wherein the turn-off time is earlier than the reference time by a set period of time corresponding to a time required for the fixing rotary body to rotate the set circumferential distance.

2. The fixing device according to claim 1, wherein the trailing end portion of the recording medium is a trailing edge of the recording medium or a trailing end of the toner image on the recording medium in the conveyance direction of the recording medium.

3. The fixing device according to claim 1, wherein the fixing rotary body includes a fixing roller.

4. The fixing device according to claim 1, wherein the pressing rotary body includes a pressing roller.

5. The fixing device according to claim 1, wherein the heater includes an induction heater.

6. An image forming apparatus comprising the fixing device according to claim 1.

7. The image forming apparatus according to claim 6, wherein the trailing end portion of the recording medium is a trailing edge of the recording medium or a trailing end of the toner image on the recording medium in the conveyance direction of the recording medium.

8. The image forming apparatus according to claim 7, further comprising a transfer roller disposed upstream from the fixing device in the conveyance direction of the recording medium to feed the recording medium toward the fixing device, wherein when the trailing end portion of the recording medium is the trailing edge of the recording medium, the timing calculator calculates the reference time based on a feeding time at which the transfer roller feeds the recording medium toward the fixing device.

9. The image forming apparatus according to claim 7, further comprising:

a photoconductive drum; and a writer to emit a light beam onto the photoconductive drum to write an electrostatic latent image thereon, wherein when the trailing end portion of the recording medium is the trailing end of the toner image on the recording medium, the timing calculator calculates the reference time based on a writing time at which the writer writes the electrostatic latent image on the photoconductive drum.

10. A method for fixing a toner image on a recording medium, comprising:

rotating a fixing rotary body in a set direction of rotation;

pressing a pressing rotary body against the fixing rotary body to form a fixing nip therebetween through which the recording medium bearing the toner image is conveyed;

turning on a heater to heat the fixing rotary body;

conveying the recording medium bearing the toner image toward the fixing nip;

calculating a reference time at which a trailing end portion of the recording medium in a conveyance direction of the recording medium reaches the fixing nip; and turning off the heater at a turn-off time earlier than the reference time, wherein the turn-off time is earlier than the reference time by a set period of time corresponding to a time required for the fixing rotary body to rotate a set circumferential distance between the heater and the fixing nip along a circumferential surface of the fixing rotary body in the direction of rotation of the fixing rotary body.

11. The method according to claim 10, wherein the trailing end portion of the recording medium is a trailing edge of the recording medium or a trailing end of the toner image on the recording medium in the conveyance direction of the recording medium.

12. The method according to claim 11, wherein the step of calculating the reference time further comprises calculating the reference time based on a feeding time at which a transfer roller disposed upstream from the fixing nip in the conveyance direction of the recording medium feeds the recording medium toward the fixing nip.

13. The method according to claim 11, wherein the step of calculating the reference time further comprises calculating the reference time based on a writing time at which a writer writes an electrostatic latent image on a photoconductive drum that is to be visualized as the toner image.

14. An image forming apparatus, comprising:

a fixing device including:

a fixing rotary body rotatable in a set direction of rotation;

a pressing rotary body disposed parallel to and pressed against the fixing rotary body to form a fixing nip therebetween through which a recording medium bearing a toner image is conveyed;

a heater to heat the fixing rotary body, disposed opposite a circumferential surface of the fixing rotary body and upstream from the fixing nip a set circumferential distance along the circumferential surface of the fixing rotary body in the direction of rotation of the fixing rotary body;

a heater driver operatively connected to the heater to turn on and off the heater;

a timing calculator to calculate a reference time at which a trailing end portion of the recording medium in a conveyance direction of the recording medium reaches the fixing nip; and a heater driver controller operatively connected to the timing calculator and the heater driver to cause the heater driver to turn off the heater at a turn-off time earlier than the reference time calculated by the timing calculator; and a transfer roller disposed upstream from the fixing device in the conveyance direction of the recording medium to feed the recording medium toward the fixing device, wherein the trailing end portion of the recording medium is a trailing edge of the recording medium or a trailing end of the toner image on the recording medium in the conveyance direction of the recording medium, and wherein when the trailing end portion of the recording medium is the trailing edge of the recording medium, the timing calculator calculates the reference time based on a feeding time at which the transfer roller feeds the recording medium toward the fixing device.

15. An image forming apparatus, comprising:

a fixing device including:

a fixing rotary body rotatable in a set direction of rotation;

a pressing rotary body disposed parallel to and pressed against the fixing rotary body to form a fixing nip therebetween through which a recording medium bearing a toner image is conveyed;

a heater to heat the fixing rotary body, disposed opposite a circumferential surface of the fixing rotary body and upstream from the fixing nip a set circumferential distance along the circumferential surface of the fixing rotary body in the direction of rotation of the fixing rotary body;

a heater driver operatively connected to the heater to turn on and off the heater;

a timing calculator to calculate a reference time at which a trailing end portion of the recording medium in a conveyance direction of the recording medium reaches the fixing nip; and a heater driver controller operatively connected to the timing calculator and the heater driver to cause the heater driver to turn off the heater at a turn-off time earlier than the reference time calculated by the timing calculator;

a photoconductive drum; and a writer to emit a light beam onto the photoconductive drum to write an electrostatic latent image thereon, wherein the trailing end portion of the recording medium is a trailing edge of the recording medium or a trailing end of the toner image on the recording medium in the conveyance direction of the recording medium, and wherein when the trailing end portion of the recording medium is the trailing end of the toner image on the recording medium, the timing calculator calculates the reference time based on a writing time at which the writer writes the electrostatic latent image on the photoconductive drum.

16. A method for fixing a toner image on a recording medium, comprising:

rotating a fixing rotary body in a set direction of rotation;

pressing a pressing rotary body against the fixing rotary body to form a fixing nip therebetween through which the recording medium bearing the toner image is conveyed;

turning on a heater to heat the fixing rotary body;

conveying the recording medium bearing the toner image toward the fixing nip;

calculating a reference time at which a trailing end portion of the recording medium in a conveyance direction of the recording medium reaches the fixing nip; and turning off the heater at a turn-off time earlier than the reference time, wherein calculating the reference time further includes calculating the reference time based on a feeding time at which a transfer roller disposed upstream from the fixing nip in the conveyance direction of the recording medium feeds the recording medium toward the fixing nip, and wherein the trailing end portion of the recording medium is a trailing edge of the recording medium or a trailing end of the toner image on the recording medium in the conveyance direction of the recording medium.

17. A method for fixing a toner image on a recording medium, comprising:

rotating a fixing rotary body in a set direction of rotation;

pressing a pressing rotary body against the fixing rotary body to form a fixing nip therebetween through which the recording medium bearing the toner image is conveyed;

turning on a heater to heat the fixing rotary body;

conveying the recording medium bearing the toner image toward the fixing nip;

calculating a reference time at which a trailing end portion of the recording medium in a conveyance direction of the recording medium reaches the fixing nip; and turning off the heater at a turn-off time earlier than the reference time, wherein calculating the reference time further includes calculating the reference time based on a writing time at which a writer writes an electrostatic latent image on a photoconductive drum that is to be visualized as the toner image, and wherein the trailing end portion of the recording medium is a trailing edge of the recording medium or a trailing end of the toner image on the recording medium in the conveyance direction of the recording medium.

* * * * *